US006478550B2

(12) United States Patent
Matsuba et al.

(10) Patent No.: US 6,478,550 B2
(45) Date of Patent: Nov. 12, 2002

(54) MULTI-STAGE CAPACITY-CONTROLLED SCROLL COMPRESSOR

(75) Inventors: Kenji Matsuba, Osaka (JP); Shigeki Hagiwara, Osaka (JP); Yoshitaka Shibamoto, Osaka (JP); Hiroyuki Kuroiwa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/052,530

(22) Filed: Jan. 23, 2002

(65) Prior Publication Data

US 2002/0071773 A1 Jun. 13, 2002

Related U.S. Application Data

(63) Continuation of application No. 09/462,207, filed as application No. PCT/JP99/02761 on May 26, 1999, now abandoned.

(30) Foreign Application Priority Data

Jun. 12, 1998 (JP) ..... 10-165022

(51) Int. Cl.[7] ..... F04B 49/00; F04B 17/00; F04B 23/04; F04B 23/00

(52) U.S. Cl. ..... 417/310; 417/410.5; 417/426; 417/301; 417/287; 417/440; 417/308

(58) Field of Search ..... 417/310, 410.5, 417/426, 301, 287, 213, 440, 308

(56) References Cited

U.S. PATENT DOCUMENTS

| | | | | |
|---|---|---|---|---|
| 3,985,472 A | | 10/1976 | Virtue et al. | |
| 4,365,941 A | | 12/1982 | Tojo et al. | |
| 4,383,805 A | | 5/1983 | Teegarden et al. | |
| 4,496,296 A | * | 1/1985 | Arai et al. | 417/440 |
| 4,744,733 A | * | 5/1988 | Terauchi et al. | 417/310 |
| 4,781,549 A | | 11/1988 | Caillat | |
| 4,846,633 A | | 7/1989 | Suzaki et al. | |
| 4,886,425 A | | 12/1989 | Itahana et al. | |
| 4,904,164 A | | 2/1990 | Mabe et al. | |
| 5,112,201 A | | 5/1992 | Tamura et al. | |
| 5,167,494 A | | 12/1992 | Inagaki et al. | |
| 5,236,316 A | | 8/1993 | Lio | |
| 5,336,058 A | | 8/1994 | Yokoyama | |
| 5,562,426 A | | 10/1996 | Watanabe et al. | |
| 5,577,897 A | | 11/1996 | Inagaki et al. | |
| 5,613,841 A | | 3/1997 | Bass et al. | |
| 5,678,985 A | | 10/1997 | Brooke et al. | |
| 6,213,731 B1 | * | 4/2001 | Doepker et al. | 417/299 |

FOREIGN PATENT DOCUMENTS

| | | |
|---|---|---|
| JP | A979152 | 3/1997 |
| JP | A9170573 | 6/1997 |
| JP | PCT9902761 | 5/1999 |
| WO | WO99/64744 | 5/1999 |

* cited by examiner

*Primary Examiner*—Charles G. Freay
*Assistant Examiner*—Timothy P. Solak
(74) *Attorney, Agent, or Firm*—Birch, Stewart, Kolasch & Birch, LLP

(57) ABSTRACT

A first bypass valve (27) that sets discharge capacity to 60% is provided in a first scroll 21 of an asymmetrical spiral-type scroll compressor. Also, a second bypass valve (40) that makes suction side and discharge side communicated with each other so that set load of the compressor becomes 50% is provided outside a scroll of the first scroll (21). In this way, by closing the first and second bypass valves (27, 40), effective load of the compressor is set to 100%. Also, by opening the first bypass valve (27) and concurrently closing the second bypass valve (40), the effective load of the compressor is set to 60%. Further, by opening both the first and second bypass valves (27, 40), the effective load of the compressor is set to 30%.

11 Claims, 8 Drawing Sheets

| FIRST BYPASS VALVE 27 | SECOND BYPASS VALVE 40 | EFFECTIVE LOAD |
|---|---|---|
| OPEN | OPEN | 30% |
| OPEN | CLOSED | 60% |
| CLOSED | CLOSED | 100% |

| FIRST BYPASS VALVE 84 | SECOND SOLENOID VALVE 91 | EFFECTIVE LOAD |
|---|---|---|
| OPEN | OPEN | 30% |
| OPEN | CLOSED | 60% |
| CLOSED | CLOSED | 100% |

| FIRST BYPASS VALVE 104 | SECOND SOLENOID VALVE 111 | THIRD SOLENOID VALVE 112 | EFFECTIVE LOAD |
|---|---|---|---|
| OPEN | OPEN | OPEN | 24% |
| OPEN | CLOSED | CLOSED | 50% |
| CLOSED | OPEN | CLOSED | 75% |
| CLOSED | CLOSED | CLOSED | 100% |

MULTI-STAGE CAPACITY-CONTROLLED SCROLL COMPRESSOR

This application is a continuation of application Ser. No. 09/462,207, filed on Jan. 4, 2000, now abandoned and for which priority is claimed under 35 U.S.C. § 120. Application Ser. No. 09/462,207 is the national phase of PCT International Application No. PCT/JP99/02761 filed on May 26, 1999 under 35 U.S.C. § 371. The entire contents of each of the above-identified applications are hereby incorporated by reference. This application also claims priority of Application No. 10-165022 filed in Japan on Jun. 12, 1998 under 35 U.S.C. § 119 the entirety of which is hereby incorporated by reference.

TECHNICAL FIELD

The present invention relates to a multi-stage capacity-controlled scroll compressor which enables partial load operation in lower capacity regions.

BACKGROUND ART

Conventionally, as a scroll compressor which enables partial load operation with a bypass hole formed in a scroll, there has been available one as shown in FIG. 8 and FIG. 9, which is a sectional view taken along the line X—X of FIG. 8 (Japanese Patent Laid-Open Publication HEI 9-170573). This scroll compressor is an asymmetrical spiral-type scroll compressor in which a scrolling end of a first scroll 1 is $\pi$ (rad) longer in involute angle than a scrolling end of a second scroll 2. A first fluid working chamber A defined by an inner surface of the first scroll 1 and an outer surface of the second scroll 2, and a second fluid working chamber B defined by an outer surface of the first scroll 1 and an inner surface of the second scroll 2 are alternately opened and closed to a single low-pressure port 3. A common bypass hole 4 common to the first fluid working chamber A and the second fluid working chamber B is provided at a point j which is a point about one-scroll inwardly unwound from an outermost side contact point E of the second scroll 2 with the first scroll 1.

Then, a valve hole 5 communicating with the common bypass hole 4 is formed in the first scroll 1, and a bypass passage 6 communicating with the low-pressure port 3 is formed in a side portion of the valve hole 5. In the valve hole 5, a stepped cylindrical bypass valve 7 for opening and closing the common bypass hole 4 is internally fitted so as to be slidable. Also, a coil spring 8 is engaged with the stepped portion of the bypass valve 7, and an upper portion of the bypass valve 7 is closed by a lid member 9 and thereby partitioned from a discharge dome 10 to define an operating-pressure chamber 11. In addition, an operating-pressure line 15 communicated selectively with a low-pressure line 13 or a high-pressure line 14 by a solenoid valve 12 is connected to the operating-pressure chamber 11 via a joint tube 16. Reference numeral 17 denotes a capillary tube for preventing shortcircuit between the high-pressure line 14 and the low-pressure line 13, numeral 18 denotes a casing, and numeral 19 denotes a high-pressure port.

As described above, the common bypass hole 4 is formed at the point j, which is a point about one-round inwardly unwound from the outermost side contact point E of the second scroll 2 with the first scroll 1. Therefore, when high-pressure gas is supplied to the operating-pressure chamber 11 of the bypass valve 7 by closing the solenoid valve 12 and then the bypass valve 7 is closed, discharge capacity becomes the full capacity (100%). On the other hand, when low-pressure gas is supplied to the operating-pressure chamber 11 of the bypass valve 7 by opening the solenoid valve 12 and then the bypass valve 7 is opened, the discharge capacity becomes about 60% of the full capacity because the position of the common bypass hole 4 serves as a compression start point. In this way, the discharge capacity of the scroll compressor is switched between 100% and 60%.

In addition, it is also possible to provide two common bypass holes at a position which is about ¾-round inwardly unwound from the outermost side contact point E of the second scroll 2 with the first scroll 1, and another position which is a one-round inwardly unwound therefrom, so that three discharge capacities, 100%, 70% and 60%, can be obtained.

However, the above multi-stage capacity-controlled scroll compressor of the prior art has the following problems. First, because its volume ratio Vr considerably lowers during a 50% or lower partial load operation, there is a problem that the operational range is limited.

For example, in the case where the intrinsic volume ratio Vr of the first and second scrolls 1, 2 is Vr =2.3, since the volume ratio Vr needs to be not less than "1" even with a partial load as a compressor, the critical partial load ratio is 1/2.3=0.44, that is, a 44% operation is a limit. Indeed increasing the intrinsic volume ratio Vr causes the critical partial load ratio to lower so that a 50% or lower partial load operation is enabled, but the efficiency at the full load would be lowered in that case, conversely, so that increasing the intrinsic volume ratio Vr could not be adopted. However, in a multi-type air conditioner in which one outdoor unit serves for a plurality of indoor units, a 20% to 30% load operation is necessarily required so that when the conventional multi-stage capacity-controlled scroll compressor is applied to this multi-type air conditioner, there would arise problems that the compressor runs and stops frequently, or that optimum conditions for air-conditioning cannot be set.

Also, as a load-controlled scroll compressor, there has been available a method using inverter control of motors besides the above scroll compressor. In this case, unfortunately, an inverter circuit is required, leading to a great cost increase. Particularly in large-size inverters, there is a further problem that harmonics would be generated. There is still another problem of lubrication failure during the inverter operation, which causes a reliability deterioration of the compressor as yet another problem.

Furthermore, when a multiplicity of common bypass holes are formed with an aim of a low partial load operation of 50% or lower as described above, machinability or assemblability deterioration maybe incurred or rigidity may deteriorate because of the common bypass holes formed at central portions of the first and second scrolls. Besides, because the gas load within the scrolls of the first and second scrolls decrease to a large extent, the gas load and the centrifugal load of the movable-side second scroll are unbalanced, so that malfunction such as lubrication failures at a pin bearing (not shown) or the like may occur, or that the second scroll. may be turned over, as further problems.

DISCLOSURE OF THE INVENTION

Therefore, an object of the present invention is to provide a multi-stage capacity-controlled scroll compressor which is capable of changing 50% or lower partial load operation in multiple stages and which is low in price and high in reliability.

In order to achieve the aforementioned object, there is provided a multi-stage capacity-controlled scroll compressor comprising:

a first bypass passage formed at a specified position in a compression chamber and serving for returning compressed gas present in a fluid working chamber to a suction port;

first opening/closing means for opening and closing the first bypass passage;

a second bypass passage for communicating discharge side and suction side with each other;

second opening/closing means for opening and closing the second bypass passage and for, with the second bypass passage opened, letting high-pressure gas on the discharge side escape to the suction side by a specified quantity.

With this constitution, the second opening/closing means opens and closes the second bypass passage, by which the load of the compressor can be switched between 100% and a first specified %. On the other hand, the first opening/closing means opens and closes the first bypass passage, by which the discharge capacity of the compressor can be switched between 100% and a second specified %. Accordingly, in combinations of the opening and closing operations of the first opening/closing means and the opening and closing operations of the second opening/closing means, effective load of the compressor can be changed over in four stages. In this case, the discharge capacity of the compressor can be changed over only to the second specified % by the first opening/closing means. Therefore, if the fixed volume ratio for the compressor and the second specified % are so set that the volume ratio at which the discharge capacity of the compressor becomes the second specified % becomes 1 or more, then the volume ratio can be maintained 1 or more even when the effective load of the compressor becomes a minimum, so that high-reliability multi-stage load control can be achieved.

In an embodiment of the present invention, a first scroll and a second scroll of which the compression chamber is formed show asymmetrical spiral shapes, respectively, that a spiral end of one scroll is 180 degree longer in involute angle than a spiral end of the other scroll.

With this constitution, the first fluid working chamber defined by the inner surface of the first scroll and the outer surface of the second scroll and the second fluid working chamber defined by the outer surface of the first scroll and the inner surface of the second scroll are formed alternately at positions on the same first bypass passage. Accordingly, the high-pressure gas in the fluid working chambers is returned from the only one first bypass passage to the suction port.

In an embodiment of the present invention, the second bypass passage is provided outside a body of the compressor.

With this constitution, the second bypass passage and the second opening/closing means do not need to be formed within the compressor body, and may be formed between discharge line and suction line. Accordingly, the multi-stage capacity-controlled scroll compressor is produced with low price.

In an embodiment of the present invention, the second bypass passage and the second opening/closing means are provided each in a plural number.

With this constitution, the second bypass passage and the second opening/closing means are provided in pluralities. Accordingly, in combinations of the opening and closing operations of the second opening/closing means and the opening and closing operations of the first opening/closing means, 8 or more stages of multi-stage load control is achieved.

In an embodiment of the present invention, the second opening/closing means for opening and closing the second bypass passage is a motor-operated valve which is controllable to any arbitrary degree of openness.

With this constitution, since the opening of the second bypass passage is set to an arbitrary degree of openness, load of the compressor can be switched between 100% and any arbitrary %. Accordingly, in combinations of the opening and closing operations of the first opening/closing means and the opening and closing operations of the second opening/closing means, effective load of the compressor can be changed over in an arbitrary multiplicity of stages.

In an embodiment of the present invention, the second opening/closing means operates on a differential pressure between a pilot pressure and a pressure on the suction side or a pressure on the discharge side.

With this constitution, the control system for the second opening/closing means can be implemented with simplicity, so that the multi-stage capacity-controlled scroll compressor is produced with low price.

In an embodiment of the present invention, the multi-stage capacity-controlled scroll compressor, further comprises a liquid injection tube for cooling a low-pressure chamber communicating with the suction port.

With this constitution, the low-pressure chamber and the driving motor are cooled by cooling liquid injected from the liquid injection tube. Thus, temperature increase of the low-pressure chamber due to the return of the high-pressure gas in the compression chamber to the suction port is prevented, making it possible to lower the temperature of the discharged gas and the motor.

In an embodiment of the present invention, the first opening/closing means and the second opening/closing means operate on a pilot pressure, and a pilot port of the first opening/closing means and a pilot port of the second opening/closing means are connected to their corresponding pilot lines, respectively, via one joint fitting provided at an upper center of the compressor body.

With this constitution, the joint fitting that connects the pilot ports of the first and second opening/closing means and their respective pilot lines to each other need to be provided only one in number at an upper center of the compressor, so that the port and line connection can be taken out from one place, the casing top center. Therefore, as compared with the case where the port and line connection is taken out from two decentered places of the casing top, in which case elliptical welding with the operating tube needs to be provided at two places, the welding work between the casing top and the operating tube can be achieved with simplicity, so that the man-hours for assembly is reduced, thus allowing a further cost reduction.

In an embodiment of the present invention, a multi-stage capacity-controlled scroll compressor comprises:

the multi-stage capacity-controlled scroll compressor as defined in Claim 1, and a standard scroll compressor of a specified discharge capacity, wherein the multi-stage capacity-controlled scroll compressor and the standard scroll compressor are connected to each other in parallel.

With this constitution, a twin multi-stage capacity-controlled scroll compressor is made up of a multi-stage capacity-controlled scroll compressor and a standard scroll compressor. Accordingly, in a combination of switching to two load states of unload and full load with the standard scroll compressor and n-stage load switching with the multi-stage capacity-controlled scroll compressor, load can be changed over in 2×n stages. Thus, load control can be achieved in even further multiple stages.

In an embodiment of the present invention, the first opening/closing means operates on a pilot pressure, and a pilot port of the first opening/closing means and joint fittings for connecting a pilot line to the pilot port are connected to each other by screws.

With this constitution, the pilot port of the first opening/closing means and the joint fitting are securely connected to each other by a taper screw. Accordingly, a fitting structure which is highly resistant to variations of the joint fitting and high in leakage resistance and thermal resistance can be realized.

BEST MODE FOR CARRYING OUT THE INVENTION

Figure 1:
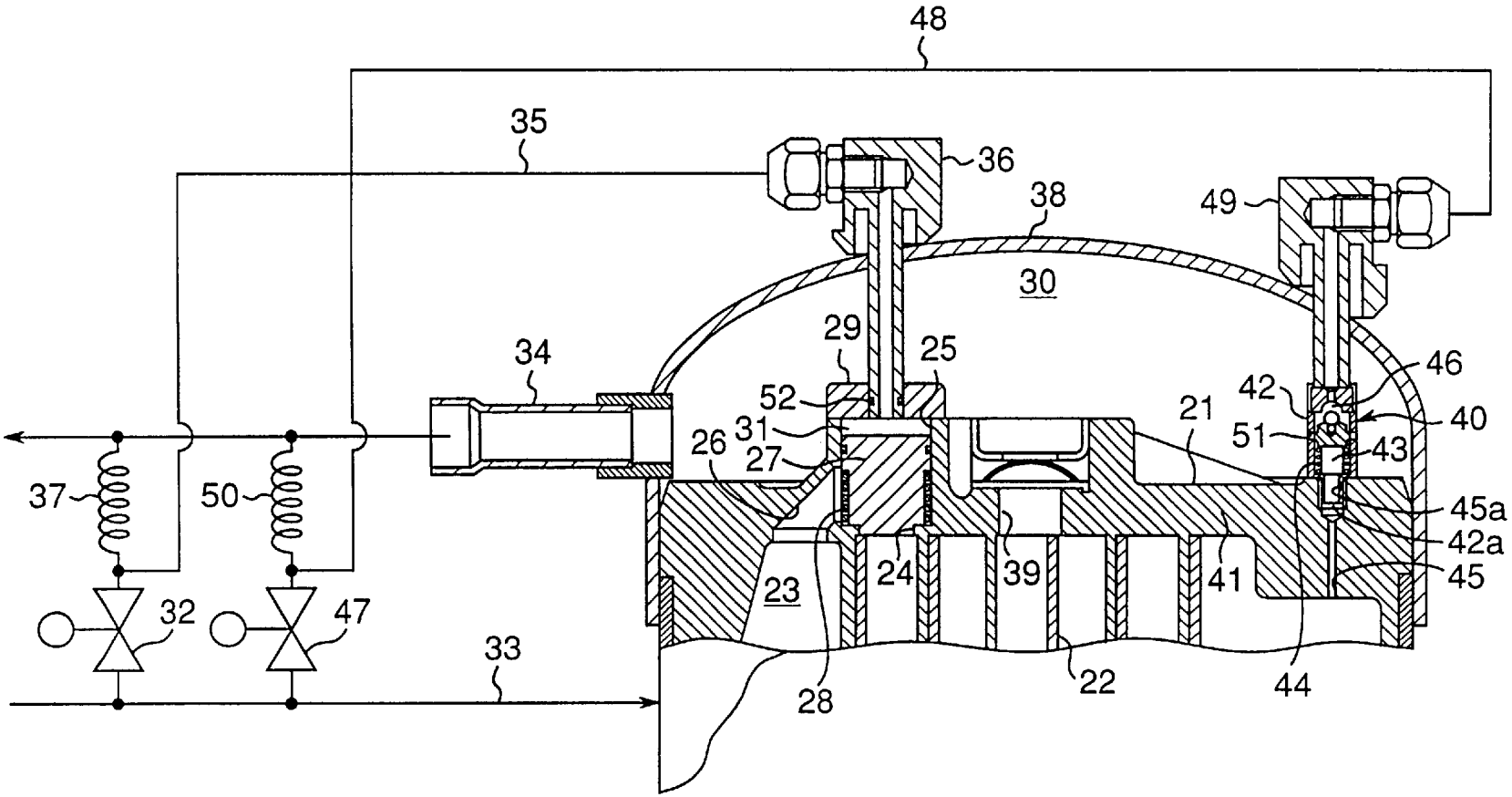
FIG. 1 is a partial sectional view of a first embodiment of the multi-stage capacity-controlled scroll compressor according to the present invention.
Figure 8:
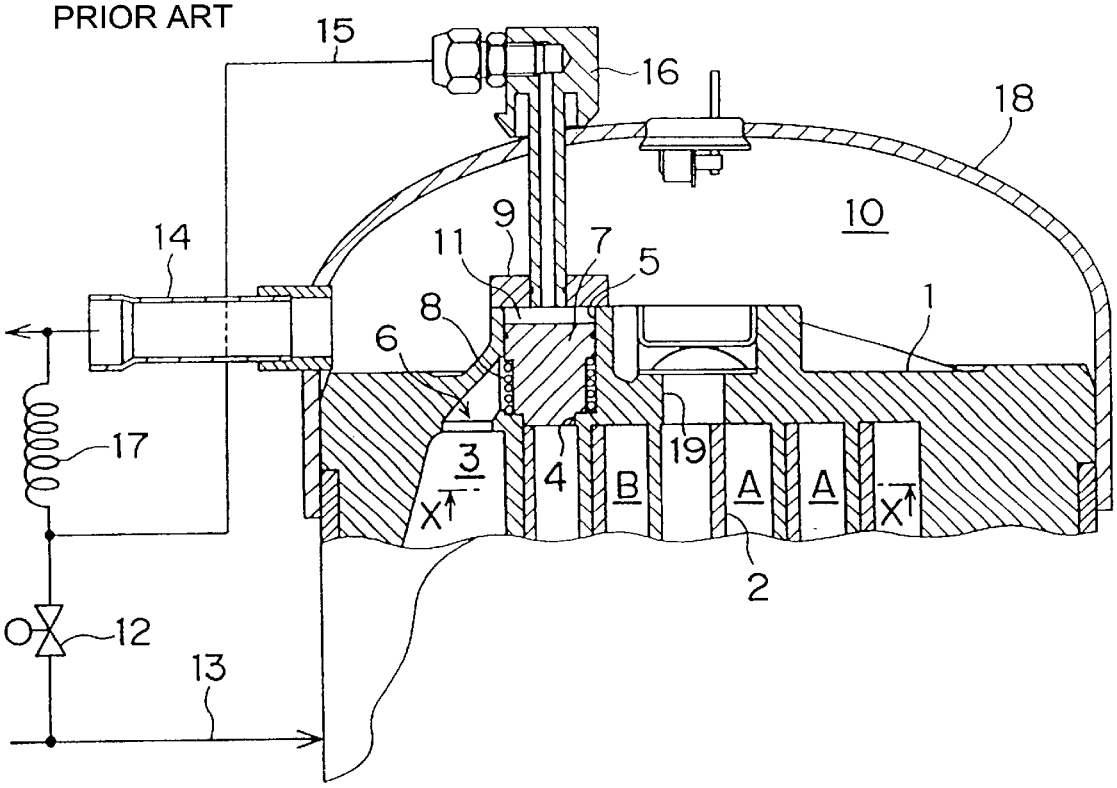
Fig. 8 PRIOR ART
FIG. 8 is a partial sectional view of a load-controlled scroll compressor according to the prior art.

Hereinbelow, the present invention is described in more detail by embodiments thereof illustrated in the accompanying drawings. FIG. 1 is a partial sectional view of a multi-stage capacity-controlled scroll compressor of a first embodiment. A first scroll 21, a second scroll 22, a low-pressure port 23, a common bypass hole 24, a valve hole 25, a bypass passage 26, a bypass valve 27, a coil spring 28, a lid member 29, a discharge dome 30, an operating-pressure chamber 31, a solenoid valve 32, a low-pressure line 33, a high-pressure line 34, an operating-pressure line 35, a joint tube 36, a capillary tube 37, a casing 38 and a high-pressure port 39 have the same constitution and operate in the same manner, respectively, as the first scroll 1, the second scroll 2, the low-pressure port 3, the common bypass hole 4, the valve hole 5, the bypass passage 6, the bypass valve 7, the coil spring 8, the lid member 9, the discharge dome 10, the operating-pressure chamber 11, the solenoid valve 12, the low-pressure line 13, the high-pressure line 14, the operating-pressure line 15, the joint tube 16, the capillary tube 17, the casing 18 and the high-pressure port 19 of the conventional asymmetrical spiral-type multi-stage capacity-controlled scroll compressor shown in FIGS. 8 and 9.

In this embodiment, the end plate of the first scroll 21 is provided a second bypass valve 40 which makes a through hole 45 selectively communicate with a suction side communicating with the low-pressure port 23 or a discharge side in the discharge dome 30. Hereinafter, the bypass valve 27 is referred to as a first bypass valve and the bypass valve 40 is referred to as a second bypass valve. The second bypass valve 40 roughly comprises a cylindrical-shaped cylinder part 42 provided so as to be protrusive on the surface on the high pressure side of an end plate 41 of the first scroll 21, a valve body 43 which has a ball at its end and slides within the cylinder 42, and a spring 44 fitted and shrunk between the valve body 43 and the cylinder 42.

At a low-pressure side end portion of the cylinder 42 is provided a fitting portion 42*a* which has a shaft hole communicating with inside of the cylinder 42 and has a fitting screw provided on its outer circumferential face. Also, in the end plate 41, the through hole 45 is bored through this end plate 41, and a fitting hole 45*a* into which the fitting portion 42*a* of the cylinder 42 is screwed is formed at an upper end portion of the through hole 45. Then, by screwing the fitting portion 42*a* of the cylinder 42 into the fitting hole 45*a* of the end plate 41, the cylinder 42 is fixed protrusively on the high-pressure side surface of the end plate 41, so that the suction side and the inside of the cylinder 42 are communicated with each other via the through hole 45 and the shaft hole of the fitting portion 42*a*. Also, an upper portion of the cylinder 42 is partitioned from the discharge dome 30 to define an operating-pressure chamber 46. Besides, an operating-pressure line 48 which is communicated selectively with the low-pressure line 33 or the high-pressure line 34 by a second solenoid valve 47 is connected to the operating-pressure chamber 46 via a joint tube 49. Hereinafter, the solenoid valve 32 is referred to as a first solenoid valve, and the solenoid valve 47 is referred to as a second solenoid valve. In addition, reference numeral 50 denotes a capillary tube for preventing shortcircuit between the high-pressure line 34 and the low-pressure line 33.

A stepped portion, which is made smaller in diameter on its low-pressure side, is formed in the outer circumferential surface of the valve body 43, and a spring 44 is fitted to this smaller-diameter portion. At an axially intermediate portion of the cylinder 42 is formed a through hole 51 which radially communicates inside and outside of the cylinder 42 with each other. When the valve body 43 has slid to its lowermost position, the through hole 51 of the cylinder 42 is closed by a larger-diameter portion of the valve body 43. It is noted that the size of the through hole 51 is so set that load of the compressor becomes 50% as an example.

Therefore, in the case where high-pressure gas is supplied to the operating-pressure chamber 46 of the second bypass valve 40 by closing the second solenoid valve 47 and the valve body 43 is slid downward, the larger-diameter portion of the valve body 43 closes the through hole 51 so that the load of the compressor is set to 100% (hereinafter, the load set in this way will be referred to as set load) . Meanwhile, in the case where low-pressure gas is supplied to the operating-pressure chamber 46 of the second bypass valve 40 by opening the second solenoid valve 47 and the valve body 43 is slid upward, the through hole 51 of the valve body 43 is opened so that the set load of the compressor becomes 50%. That is, in this embodiment, the second bypass passage is implemented by the through hole 45, while the second opening/closing means is implemented by the second bypass valve 40.

Figure 2:
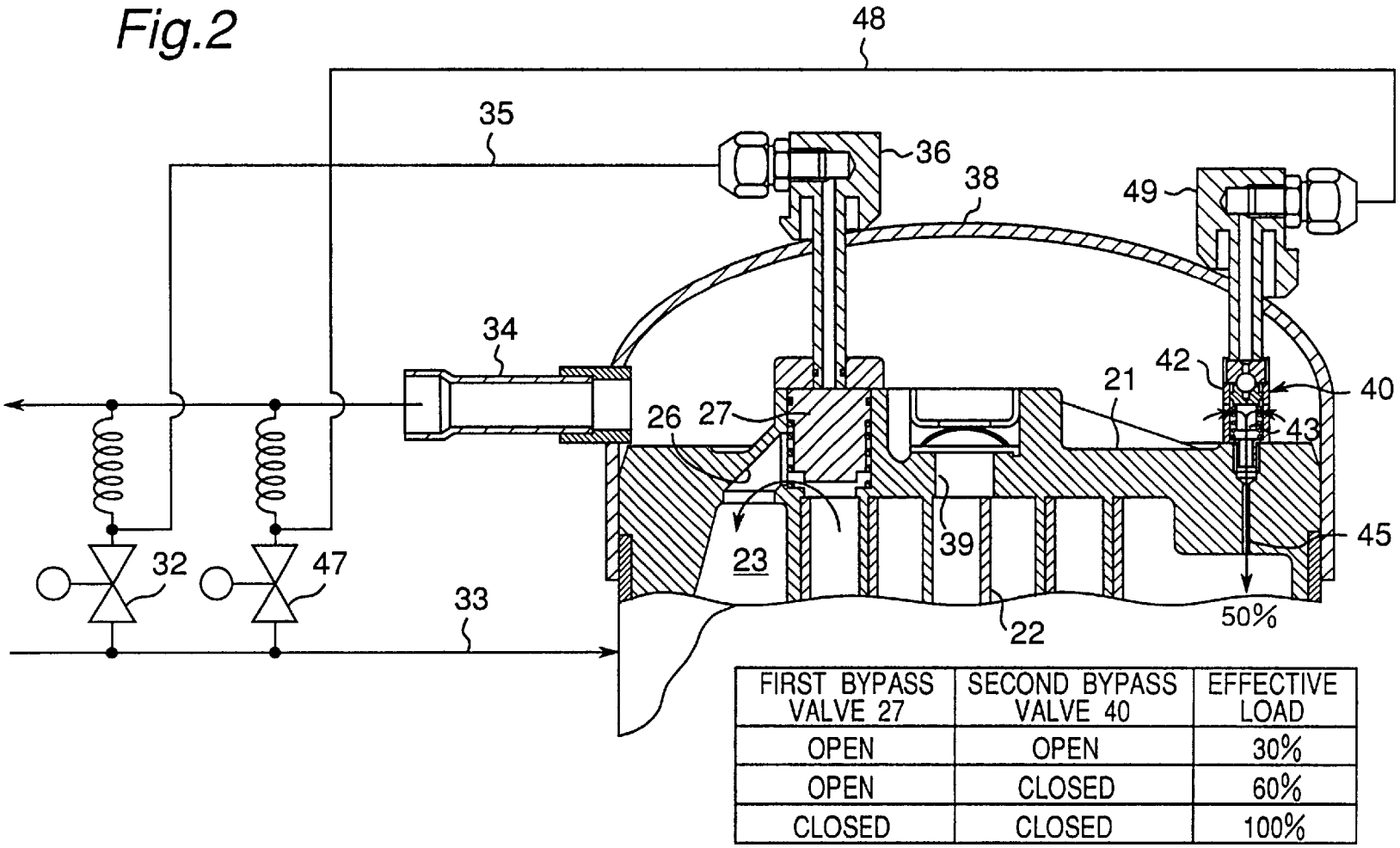
FIG. 2 is a partial sectional view in which the discharge capacity of the multi-stage capacity-controlled scroll compressor shown in FIG. 1 is 30%.

The multi-stage capacity-controlled scroll compressor having the above constitution is enabled to perform multi-stage load control, as shown below, by controlling the first bypass valve 27 and the second bypass valve 40. First, as described above, closing the second solenoid valve 47 causes the second bypass valve 40 to be closed, so that the set load of the compressor becomes 100%. In this state, closing the first solenoid valve 32 to supply high-pressure gas to the operating-pressure chamber 31 of the first bypass valve 27 causes the first bypass valve 27 to be closed so that discharge capacity becomes 100%. Accordingly, effective load of the compressor in this case is 100% (=100%×100%) (state of FIG. 1). Also, opening the first solenoid valve 32 to supply low-pressure gas to the operating-pressure chamber 31 of the first bypass valve 27 causes the first bypass valve 27 to be opened so that the discharge capacity becomes 60%. Accordingly, the effective load of the compressor in this case is 60% (=100%×60%). Next, by opening the second solenoid valve 47, the second bypass valve 40 is opened so that the set load of the compressor becomes 50%. In this state, opening the first solenoid valve 32 and thereby opening the first bypass valve 27 causes the discharge capacity to be 60%. Accordingly, the effective load of the compressor in this case is 30% (=50%×60%) (state of FIG. 2).

In this case, in the first scroll 21, the first bypass valve 27 is provided by boring the only one common bypass hole 24 only at a point J (see FIG. 9) which is about one-round inwardly unwound from an outermost side contact point E of the second scroll 22 with the first scroll 21. Therefore, the discharge capacity during minimum capacity operation is 60%. For this reason, when the intrinsic volume ratio Vr of the first and second scrolls 21, 22 is 2.3, the volume ratio Vr during the minimum capacity operation becomes 1.38 (=2.3×0.6), showing a value of not less than "1". That is, according to this embodiment, 50% or lower partial load operation with high reliability is enabled.

As shown above, in this embodiment, in the first scroll 21 of the above asymmetrical spiral-type scroll compressor, the first bypass valve 27 that communicates with the low-pressure port 23 to yield a discharge capacity of 60% is provided at the point J (see FIG. 9) which is about one-round inwardly unwound from the outermost side contact point E of the second scroll 22 with the first scroll 21. Further, the second bypass valve 40 that makes the suction side and the discharge side selectively communicated with each other to yield a 50% set load of the compressor is provided outside the scroll of the first scroll 21. Then, by opening and closing the first solenoid valve 32 and the second solenoid valve 47, the first bypass valve 27 and the second bypass valve 40 are opened and closed depending on a differential pressure between the pressure of the low-pressure line 33 or the high-pressure line 34 and the pressure on the suction side. Therefore, closing both the second bypass valve 40 and the first bypass valve 27 allows the effective load of the compressor to be 100%. Also, closing the second bypass valve 40 and concurrently opening the first bypass valve 27 allows the effective load of the compressor to be 60%. Also, opening both the second bypass valve 40 and the first bypass valve 27 allows the effective load of the compressor to be 30%.

Consequently, according to this embodiment, 50% or lower partial load operation with high reliability can be achieved by setting the volume ratio Vr during the minimum capacity operation to a value of "1" or more.

In this case, the multi-stage capacity-controlled scroll compressor having the above constitution can be implemented simply by boring the through hole 45 through the end plate 41 outside the scroll of the first scroll 21 in the conventional asymmetrical spiral-type multi-stage capacity-controlled scroll compressor having the first bypass valve 27, and by screwing the fitting portion 42*a* of the cylinder 42 to an upper end portion of the through hole 45. Also, the second bypass valve 40 to be provided outside the scroll does not require such precision as demanded for the first bypass valve 27 provided within the scroll. Accordingly, the multi-stage capacity-controlled scroll compressor can be provided with a smaller number of parts and at low price.

Figure 3:
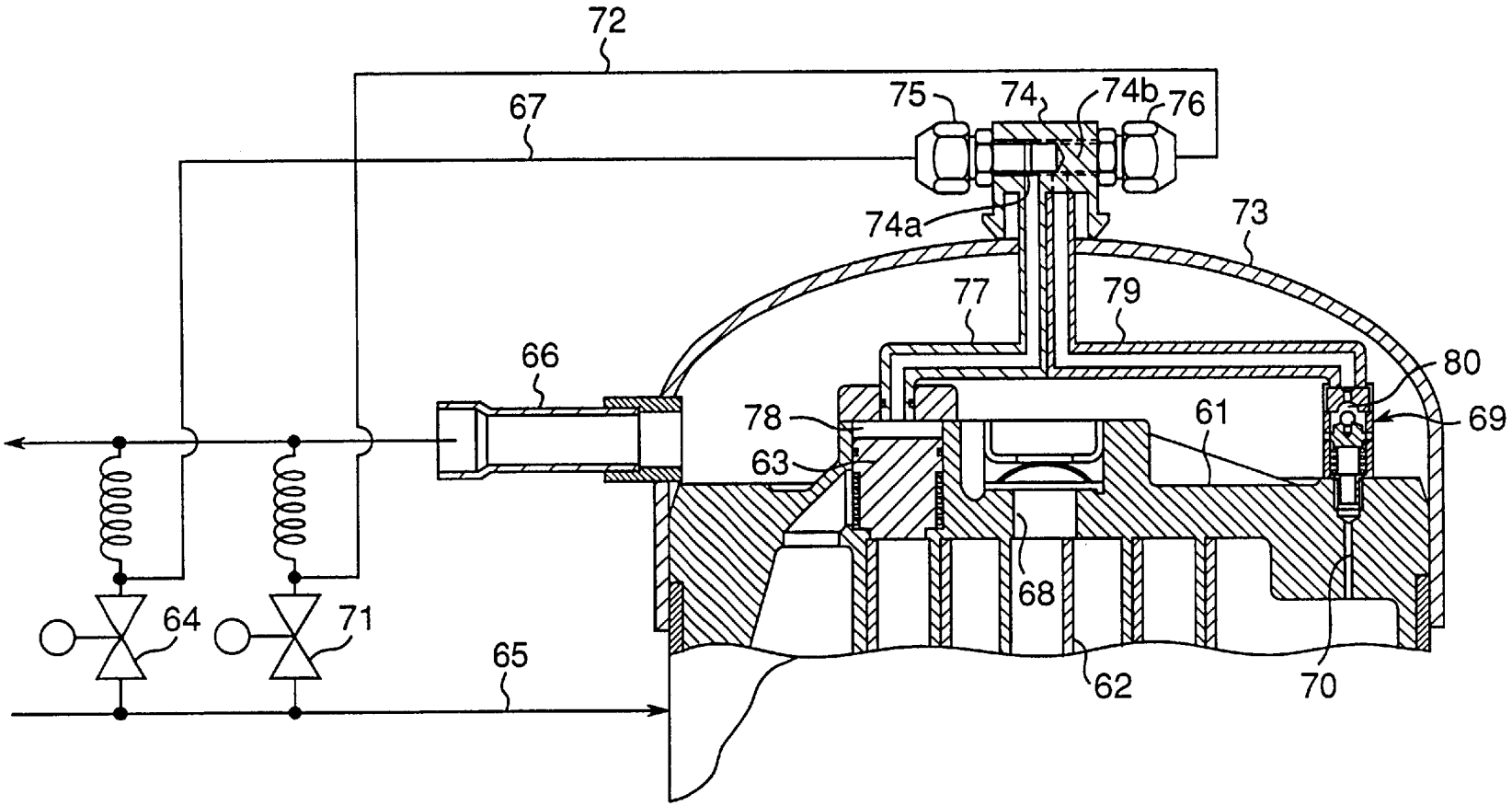
FIG. 3 is a partial sectional view of a multi-stage capacity-controlled scroll compressor other than that of FIG. 1.

FIG. 3 is a partial sectional view showing a modification example of the multi-stage capacity-controlled scroll compressor shown in FIG. 1. A first scroll 61, a second scroll 62, a first bypass valve 63, a first solenoid valve 64, a low-pressure line 65, a high-pressure line 66, an operating-pressure line 67, a high-pressure port 68, a second bypass valve 69, a through hole 70, a second solenoid valve 71 and an operating-pressure line 72 of the multi-stage capacity-controlled scroll compressor shown in FIG. 3 have the same constitution and operate in the same manner, respectively, as the first scroll 21, the second scroll 22, the first bypass valve 27, the first solenoid valve 32, the low-pressure line 33, the high-pressure line 34, the operating-pressure line 35, the high-pressure port 39, the second bypass valve 40, the through hole 45, the second solenoid valve 47 and the operating-pressure line 48 of the multi-stage capacity-controlled scroll compressor shown in FIG. 1.

In this embodiment, the operating-pressure lines 67, 72 are connected to the first bypass valve 63 and the second bypass valve 69 via one joint tube 74 fitted to a top center of a casing 73. With two holes 74*a*, 74*b* formed alternately in the joint tube 74, the operating-pressure line 67 is connected to the first hole 74*a* by a first bolt joint 75, while the operating-pressure line 72 is connected to the second hole 74*b* by a second bolt joint 76. Further, an operating-pressure chamber 78 of the first bypass valve 63 is connected to the first hole 74*a* by a first piping 77, while an operating-pressure chamber 80 of the second bypass valve 69 is connected to the second hole 74*b* by a second piping 79.

As shown above, by drawing out the two operating-pressure lines 67, 72 collectively by the one joint tube 74 from the top center of the casing 73, the assembly man-hours can be reduced so that a further cost reduction can be achieved.

Figure 4:
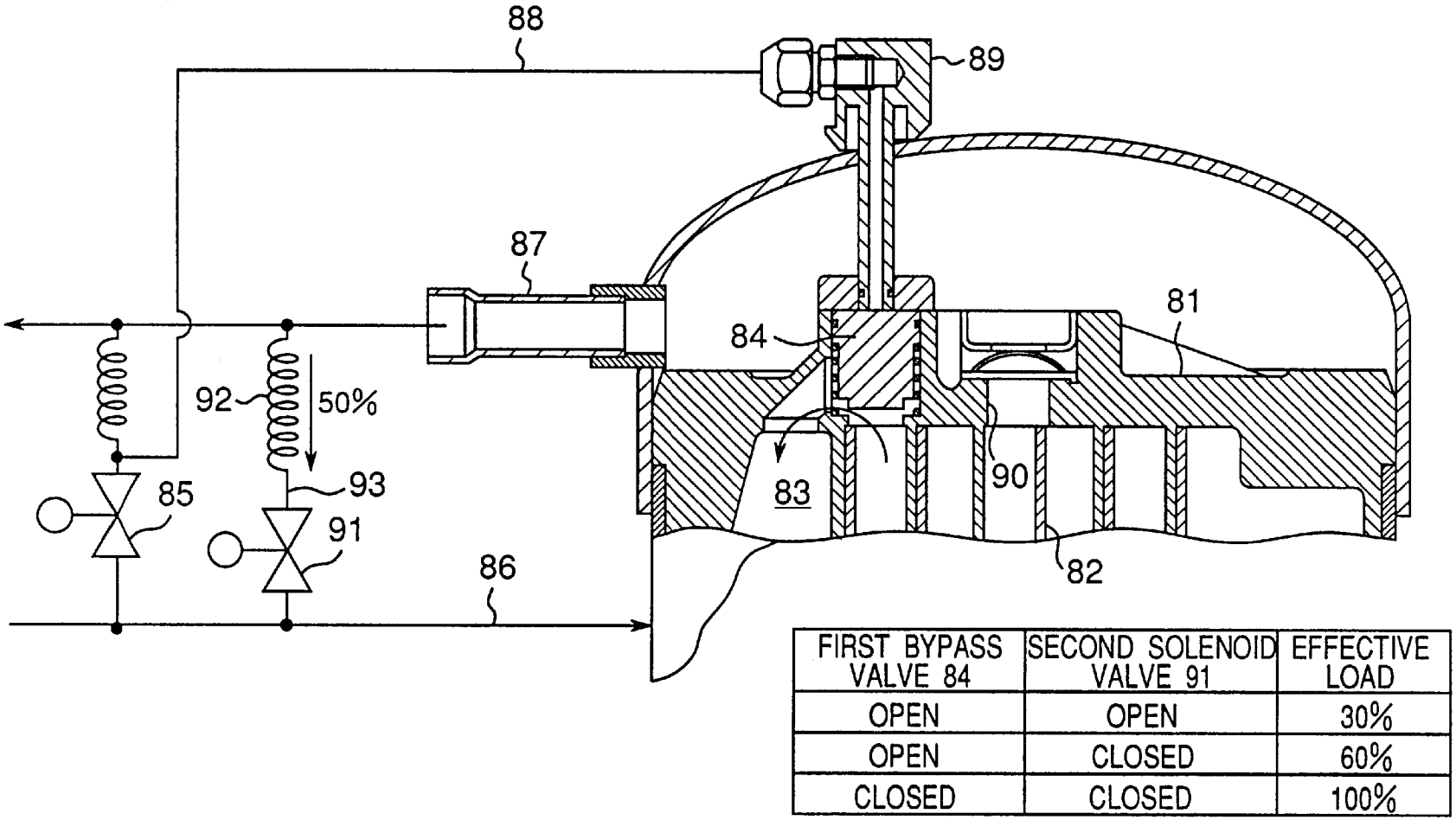
FIG. 4 is a sectional view of a multi-stage capacity-controlled scroll compressor according to a second embodiment.

FIG. 4 is a partial sectional view showing a multi-stage capacity-controlled scroll compressor according to a second embodiment. A first scroll 81, a second scroll 82, a low-pressure port 83, a bypass valve 84, a first solenoid valve 85, a low-pressure line 86, a high-pressure line 87, an operating-pressure line 88, a joint tube 89 and a high-pressure port 90 have the same constitution and operate in the same manner, respectively, as the first scroll 21, the second scroll 22, the low-pressure port 23, the first bypass valve 27, the first solenoid valve 32, the low-pressure line 33, the high-pressure line 34, the operating-pressure line 35, the joint tube 36 and the high-pressure port 39 of the multi-stage capacity-controlled scroll compressor shown in FIG. 1.

In the multi-stage capacity-controlled scroll compressor shown in FIG. 1, the second bypass valve 40, which is provided in an upper portion of the through hole 45 bored in the end plate 41 of the first scroll 21, is opened and closed so that the second bypass valve 40 makes the low-pressure inner side of the end plate 41 selectively communicate with the suction side or the discharge side, by which the set load of the compressor is switched between 100% and 50%. In addition, the selective communication between the suction side and the discharge side can be achieved in another way.

In FIG. 4, the low-pressure line 86 and the high-pressure line 87 are connected to each other by a bypass passage 93 on which a second solenoid valve 91 and a capillary tube 92 are provided interveniently, by which the selective communication between the suction side and the discharge side is enabled. In addition, the capillary tube 92 prevents short-circuit between the high-pressure line 87 and the low-pressure line 86. Taking as an example a case in which the second solenoid valve 91 is so designed that the set load of the compressor with the second solenoid valve 91 opened becomes 50%, operation of the multi-stage capacity-controlled scroll compressor in this embodiment is described below.

In this multi-stage capacity-controlled scroll compressor, by controlling the opening and closing operations of the first solenoid valve 85 and the second solenoid valve 91, multi-stage load control is performed in the following manner. First, by closing the second solenoid valve 91, the set load of the compressor becomes 100%. In this state, closing the first solenoid valve 85 causes the first bypass valve 84 to be closed so that the discharge capacity becomes 100%. Accordingly, the effective load of the compressor in this case is 100%. Also, opening the first solenoid valve 85 causes the first bypass valve 84 to be opened so that the discharge capacity becomes 60%. Accordingly, the effective load of the compressor in this case is 60%. Next, by opening the second solenoid valve 91, the set load of the compressor becomes 50%. In this state, opening the first solenoid valve 85 causes the discharge capacity to be 60%. Accordingly, the effective load of the compressor in this case is 30%. In this way, as in the case of the first embodiment, 50% or lower partial load operation with high reliability can be achieved by setting the volume ratio Vr during the minimum capacity operation to "1" or more.

In this embodiment, the selective communication between the suction side and the discharge side is enabled by a very simple means of connecting the low-pressure line 86 and the high-pressure line 87 to each other by the bypass passage 93 on which the second solenoid valve 91 is interveniently provided. Therefore, it is no longer necessary to provide the second bypass valve 40 within the compressor body, unlike the first embodiment, so that a further cost reduction can be achieved.

In addition, when a motor-operated valve controllable in degree of openness by a stepping motor or the like is used instead of the second solenoid valve 91, the set load of the compressor can be changed in multiple stages arbitrarily. Therefore, in that case, in combination with the opening/closing operations of the first solenoid valve 85, 50% or lower arbitrary multi-stage load control with high reliability can be achieved.

Figure 5:
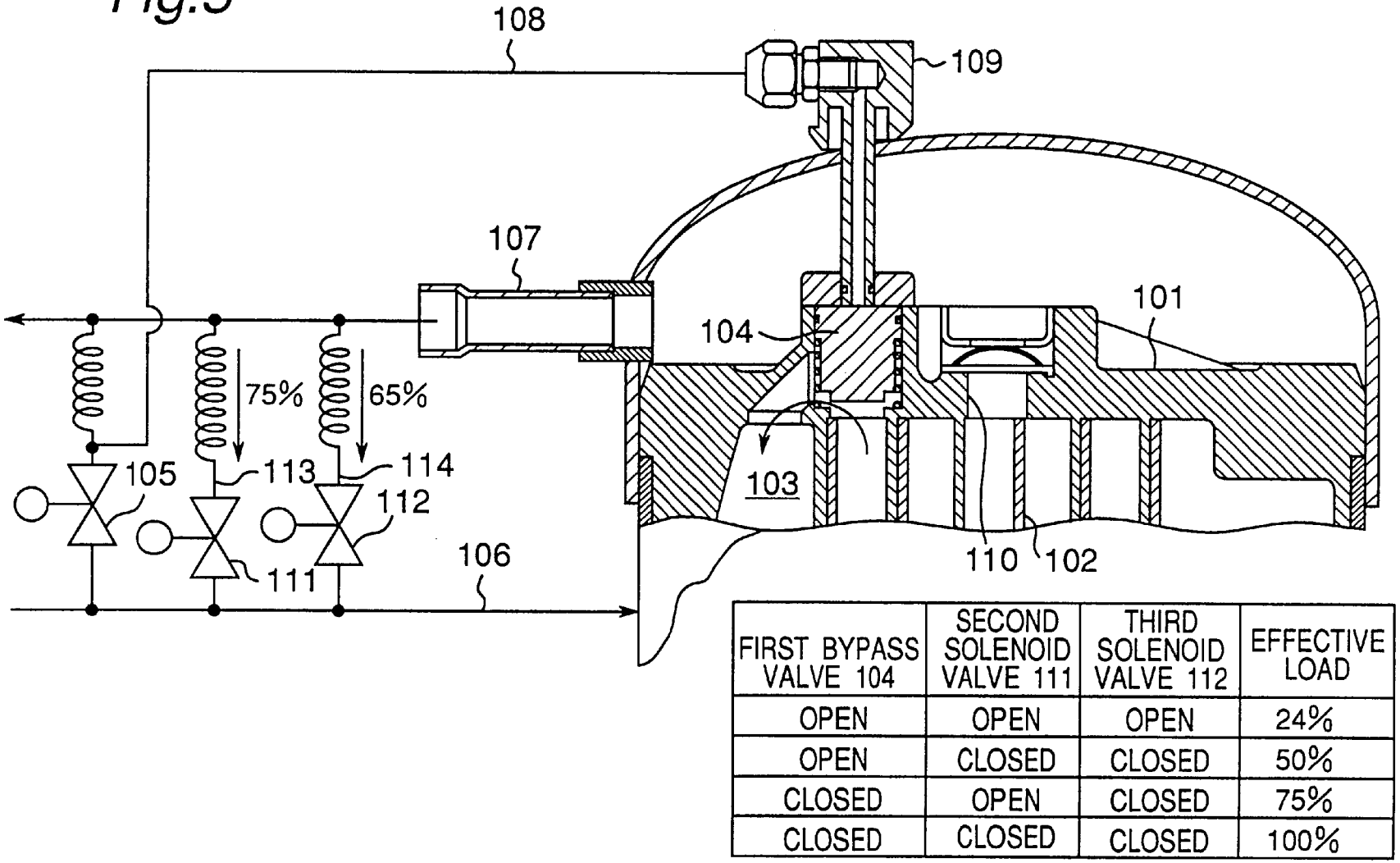
FIG. 5 is a partial sectional view of a multi-stage capacity-controlled scroll compressor other than that of FIG. 4.

FIG. 5 is a partial sectional view showing a modification example of the multi-stage capacity-controlled scroll compressor shown in FIG. 4. A first scroll 101, a second scroll 102, a low-pressure port 103, a bypass valve 104, a first solenoid valve 105, a low-pressure line 106, a high-pressure line 107, an operating-pressure line 108, a joint tube 109 and a high-pressure port 110 of the multi-stage capacity-controlled scroll compressor shown in FIG. 5 have the same constitution and operate in the same manner, respectively, as the first scroll 21, the second scroll 22, the low-pressure port 23, the first bypass valve 27, the first solenoid valve 32, the low-pressure line 33, the high-pressure line 34, the operating-pressure line 35, the joint tube 36 and the high-pressure port 39 of the multi-stage capacity-controlled scroll compressor shown in FIG. 1. However, it is assumed that the bypass valve 104 is provided at such a position that the discharge capacity becomes 50%.

In FIG. 5, the low-pressure line 106 and the high-pressure line 107 are connected to each other by a bypass passage 113 on which a second solenoid valve 111 that sets the set load of the compressor in the opened state to 75% is provided interveniently, and by a bypass passage 114 on which a third solenoid valve 112 that sets the set load of the compressor in the opened state to 65% is provided interveniently. Then, by controlling the opening and closing operations of the first solenoid valve 105, the second solenoid valve 111 and the third solenoid valve 112, multi-stage load control is performed in the following manner.

First, by closing both the second solenoid valve 111 and the third solenoid valve 112, the set load of the compressor becomes 100%. In this state, closing the first solenoid valve 105 causes the first bypass valve 104 to be closed so that the discharge capacity becomes 100%. Accordingly, the effective load of the compressor in this case is 100%. Also, opening the first solenoid valve 105 causes the first bypass valve 104 to be opened so that the discharge capacity becomes 50%. Accordingly, the effective load of the compressor in this case is 50%. Next, by closing the third solenoid valve 112 and concurrently opening the second solenoid valve 111, the set load of the compressor becomes 75%. In this state, closing the first solenoid valve 105 causes the discharge capacity to be 100%. Accordingly, the effective load of the compressor in this case is 75%. Next, by opening both the second solenoid valve 111 and the third solenoid valve 112, the set load of the compressor comes 49% (=75%×65%). In this state, opening the first solenoid valve 105 causes the discharge capacity to be 50%. Accordingly, the effective load of the compressor in this case is 24% (=75%×65%×50%). In this way, 50% or lower multi-stage load control with high reliability can be achieved by setting the volume ratio Vr during the minimum capacity operation to "1" or more. In addition, although the above explanation has been made with an example of four-stage load control, up to 8-stage load control can be implemented.

Figure 6:
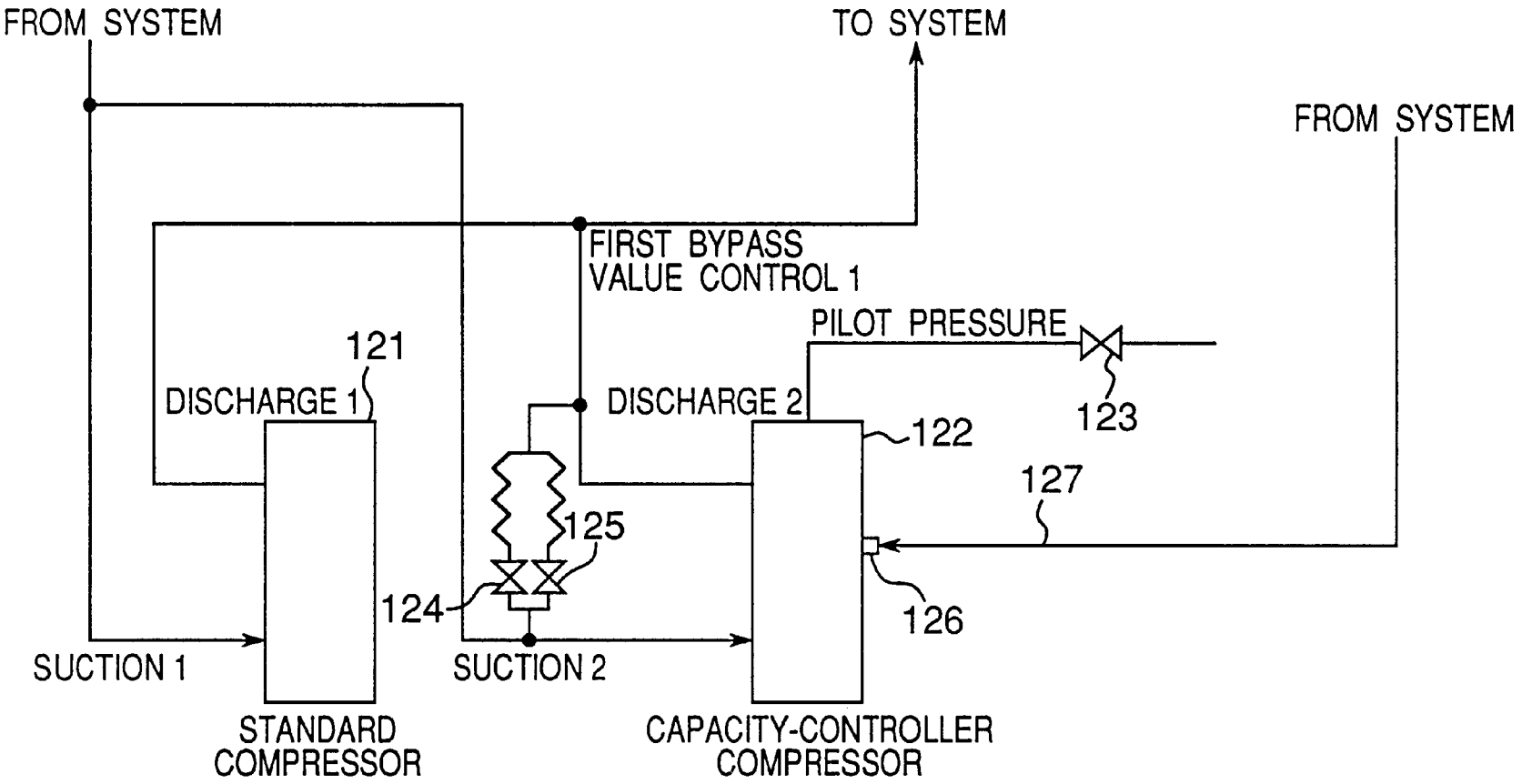
FIG. 6 is an arrangement view of a multi-stage capacity-controlled scroll compressor according to a third embodiment.

FIG. 6 is an arrangement view of a multi-stage capacity-controlled scroll compressor according to a third embodiment. In this embodiment, by combining a multi-stage capacity-controlled scroll compressor having any one of the constitutions of the foregoing embodiments (hereinafter, referred to as capacity-controlled compressor) and a standard-structure (non capacity-controlled) scroll compressor (hereinafter, referred to as standard compressor), 50% or lower high-multi-stage load control is performed.

The standard compressor 121 is a non-capacity-controlled type scroll compressor having a maximum discharge capacity one half the maximum capacity required by a system to which high-pressure gas is supplied (hereinafter, the maximum capacity required will be referred to simply as necessary maximum capacity). The capacity-controlled compressor 122 is, for example, a multi-stage capacity-controlled scroll compressor shown in FIG. 5, which has a maximum discharge capacity one half the necessary maximum capacity of the system. In the capacity-controlled compressor 122, discharge capacity is switched between 100% and 50% by controlling the opening and closing operations of the bypass valve (see FIG. 5) with a first solenoid valve 123 opened and closed, set load of the compressor is switched between 100% and 75% by opening and closing a second solenoid valve 124, and the set load of the compressor is switched between 100% and 65% by opening and closing a third solenoid valve 125. In addition, a liquid injection tube 126 having a nozzle is provided, for example, outside the scroll of the first scroll in the capacity-controlled compressor 122, and a liquid line 127 from the system side is connected to this liquid injection tube 126.

The multi-stage capacity-controlled scroll compressor of the above constitution operates in the following manner.

First, the standard compressor 121 is put into an unload state. In this state, the capacity-controlled compressor 122 is set to an effective load of 24% as described above. Then, the discharge capacity from the standard compressor 121 to the system is 0% (=50%×0%) of the necessary maximum capacity and the discharge capacity from the capacity-controlled compressor 122 to the system is 12% (=50%×24%) of the necessary maximum capacity, so that the effective discharge capacity to the system is 12% (=standard compressor 0%+capacity-controlled compressor 12%) of the necessary maximum capacity. Likewise, setting the effective load of the capacity-controlled compressor 122 to 50% causes the discharge capacity to the system to be 25% (=50%×50%) of the necessary maximum capacity, so that the effective discharge capacity to the system is 25% of the necessary maximum capacity. Also, setting the effective load of the capacity-controlled compressor 122 to 75% causes the effective discharge capacity to the system to be 37.5% of the necessary maximum capacity. Setting the effective load of the capacity-controlled compressor 122 to 100% causes the effective discharge capacity to the system to be 50% of the necessary maximum capacity.

Next, the standard compressor 121 is put into a full-load (100%) state. In this state, the capacity-controlled compressor 122 is set to an effective load of 24% in the way as described above. Then, the discharge capacity from the standard compressor 121 to the system is 50% (=50%×100%) of the necessary maximum capacity, and the discharge capacity from the capacity-controlled compressor 122 to the system is 12% (=50%×24%) of the necessary maximum capacity, so that the effective discharge capacity to the system is 62% (=standard compressor 50%+capacity-controlled compressor 12%) of the necessary maximum capacity. Likewise, setting the effective load of the capacity-controlled compressor 122 to 50% causes the effective discharge capacity to the system to be 75% of the necessary maximum capacity. Also, setting the effective load of the capacity-controlled compressor 122 to 75% causes the effective discharge capacity to the system to be 87.5% of the necessary maximum capacity. Setting the effective load of the capacity-controlled compressor 122 to 100% causes the effective discharge capacity to the system to be 100% of the necessary maximum capacity.

In this case, in the capacity-controlled compressor 122, because high-temperature, high-pressure gas in the discharge dome is returned to the suction side, the compressor section comprising the first scroll and the second scroll or the motor that drives the second scroll increase in temperature. Therefore, in this embodiment, a liquid injection tube 126 is provided in the capacity-controlled compressor 122 so that a liquid coolant is injected from the system side. Accordingly, the injected liquid coolant flows down from the compressor section comprising the first scroll and the second scroll toward the motor that drives the second scroll into rotation, by which the compressor section and the motor are cooled. In this way, the discharge gas and the motor are lowered in temperature, so that the operable range is enlarged. In addition, the provision of the liquid injection tube in the capacity-controlled compressor may be applied to the multi-stage capacity-controlled scroll compressors of the first and second embodiments.

As described above, in this embodiment, a twin multi-stage capacity-controlled scroll compressor is made up of the standard compressor 121 having a maximum discharge capacity which is one half of the maximum capacity required for the system, and the capacity-controlled compressor 122 having a maximum discharge capacity which is one half of the maximum capacity required for the system. Therefore, by changing over the effective load of the capacity-controlled compressor 122 to 24%, 50%, 75% and 100% simultaneously when the standard compressor 121 is switched between the unload state and the full load state, the effective discharge capacity from the twin multi-stage capacity-controlled scroll compressor to the system can be changed over to 8 stages of 12%, 25%, 37.5%, 50%, 62%, 75%, 87.5% and 100% of the necessary maximum capacity of the system. Also, if the effective load of the capacity-controlled compressor 122 is changed over in the maximum 8 stages, then the effective discharge capacity from the twin multi-stage capacity-controlled scroll compressor to the system can be changed over in 16 stages. In addition, although the above description has been made on the assumption that the maximum discharge capacity of the standard compressor 121 and the capacity-controlled compressor 122 is one half of the necessary maximum capacity of the system for simpler explanation, the maximum discharge capacity may be set as appropriate, depending on required effective discharge capacity, without being limited to the above case.

The joint tube 36 to be connected to the operating-pressure chamber 31 of the first bypass valve 27 in the foregoing embodiments (typified by the first embodiment hereinbelow) is fitted with its end being inserted into a hole bored in the lid member 29, and further sealed by an O-ring 52. However, such a fitting structure is weak to vibrations of the joint tube 36, which may lead to occurrence of leakage depending on conditions of use. Further, there is a problem of thermal resistance. Thus, a fitting structure as shown in FIGS. 7A and 7B are adopted in the fourth embodiment.

Figure 7A:
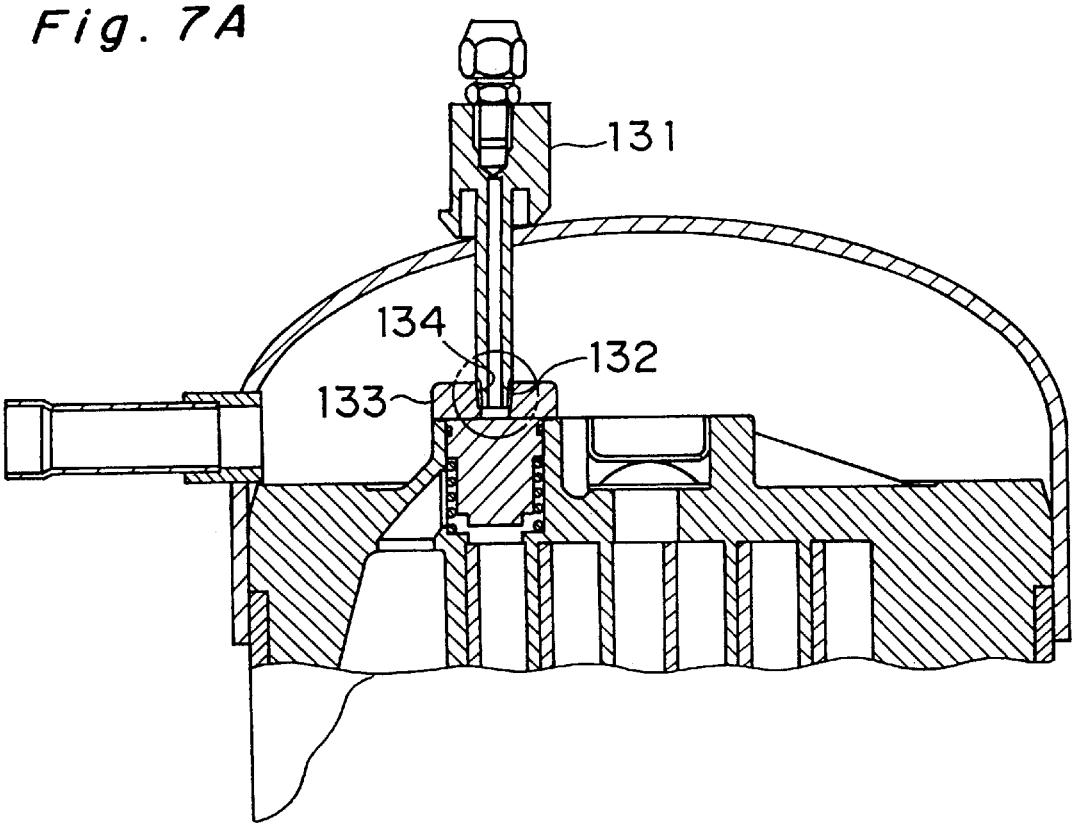
FIGS. 7A and 7B are views showing a fitting structure other than the fitting structure of the joint tube to the lid member in FIG. 1 and FIGS. 3 to 5.
Figure 7B:
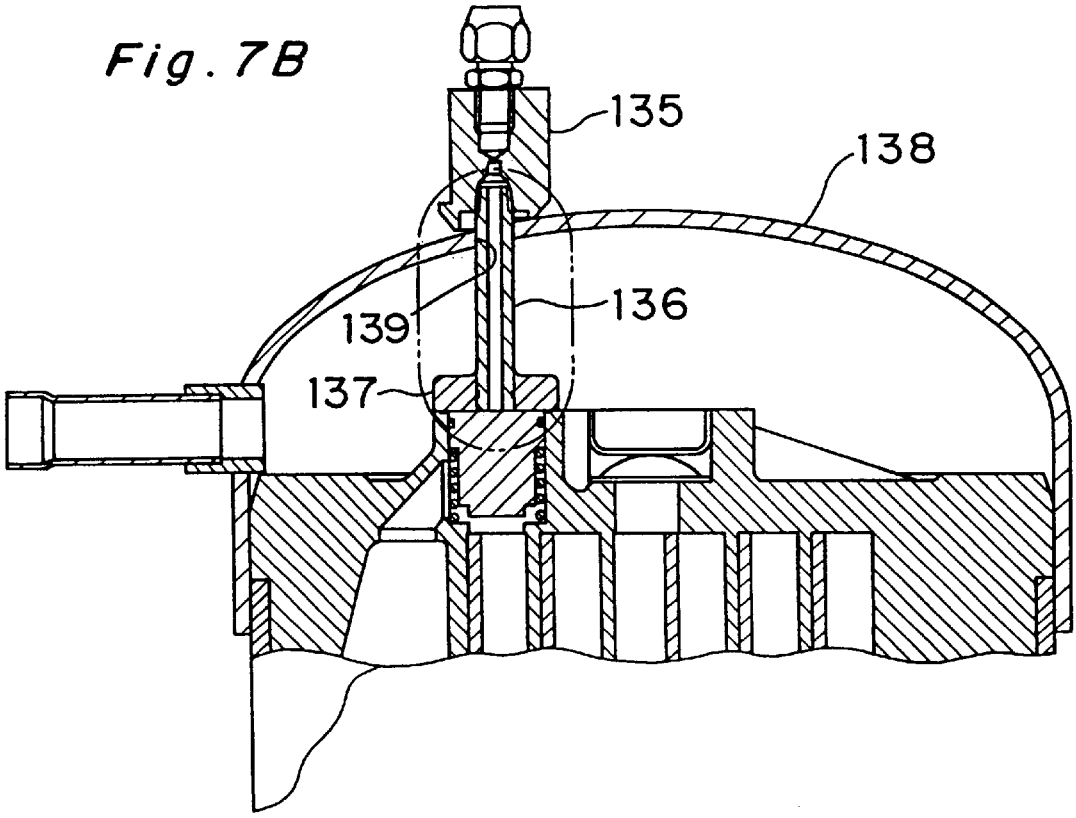

In FIG. 7A, a male screw 132 is provided at a taper portion of an end of a joint tube 131, while a female screw 134 is provided at a taper hole of a lid member 133. Then, the taper portion of the end of the joint tube 131 is screwed into the taper hole of the lid member 133, by which the joint tube 131 is fitted to the lid member 133. By sealing with a taper screw in this way, a fitting structure of the joint tube 131 which is strong to vibrations and high in leakage resistance and thermal resistance can be obtained. Further, in FIG. 7B, a joint tube body 135 and a tube body 136 are separated from each other, and the tube body 136 and a lid member 137 are formed integrally. Then, an end of the tube body 136 is protruded through a hole 139 of a casing 138, and fixed by welding at the place of the hole 139. Then, the taper hole of the joint tube body 135 is screwed to the taper portion of the end of the tube body 136. Like this, by integrally forming the tube body 136 and the lid member 137 and by coupling the integral unit to the joint tube body 135 with a taper screw, a fitting structure which is strong to vibrations of the tube body 136 and high in leakage resistance and thermal resistance can be obtained.

Figure 9:
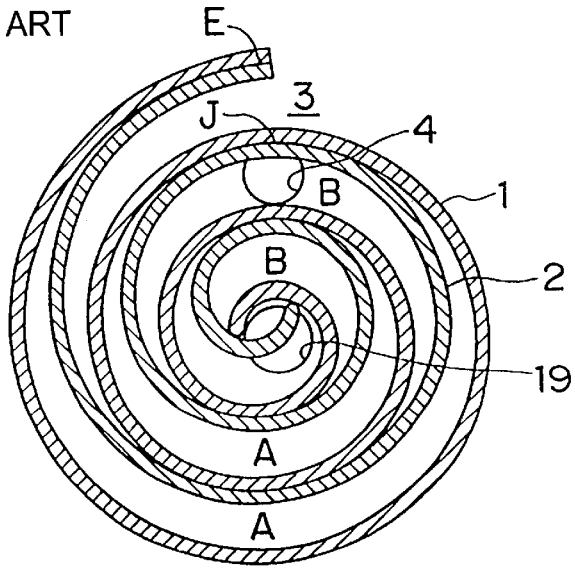
Fig. 9 PRIOR ART
FIG. 9 is a view taken along the line X—X of FIG. 8.

In addition, the above embodiments have been described, taking as an example a so-called asymmetrical spiral-type scroll compressor in which, as shown in FIG. 9, the spiral end of the first scroll 21, 61, 81, 101 is $\pi$ (rad) longer in involute angle than the spiral end of the second scroll 22, 62, 82, 102, and in which the outermost side contact point E of the second scroll 22, 62, 82, 102 with the first scroll 21, 61, 81, 101 is the aforementioned spiral end. However, the present invention is not limited to this, and can be applied to so-called symmetrical spiral-type scroll compressors in which spiral ends of a symmetrical pair of scrolls are shifted from each other by $\pi$ (rad) in involute angle. In the case of this symmetrical spiral-type scroll compressor, however, the first fluid working chamber A defined by the inner surface of the first scroll and the outer surface of the second scroll, and the second fluid working chamber B defined by the outer surface of the first scroll and the inner surface of the second scroll are not formed at the same position but formed so as to be opposed to each other, in which case therefore the first bypass valve for changing the discharge capacity of the compressor needs to be provided two in number, one for the first fluid working chamber A and the other for the second fluid working chamber B, at positions opposed to each other.

What is claimed:

1. A multi-stage capacity-controlled scroll compressor comprising:

a casing;

a compression portion having a first scroll and a second scroll and arranged in the casing such that a fluid working chamber is defined between the first and second scrolls;

a discharge chamber formed between the compression portion and an inner surface of the casing;

a first bypass passage communicating a port that is formed in the fluid working chamber between a low-pressure port at one end of the fluid working chamber and a high-pressure port at the other end of the fluid working chamber with the low-pressure port;

a first opening/closing means for opening and closing the first bypass passage;

a second bypass passage provided within said casing for communicating the discharge chamber with a suction-side chamber communicating with the low-pressure port;

a second opening/closing means for opening and closing the second bypass passage.

2. The multi-stage capacity-controlled scroll compressor according to claim 1, wherein a first scroll and a second scroll of which the compression chamber is formed show asymmetrical spiral shapes, respectively, that a spiral end of one scroll is 180 degree longer in involute angle than a spiral end of the other scroll.

3. The multi-stage capacity-controlled scroll compressor according to claim 1, wherein the second opening/closing means operates on a differential pressure between a pilot pressure and a pressure in the suction-side chamber or a pressure in the discharge chamber.

4. The multi-stage capacity-controlled scroll compressor according to claim 1, further comprising a liquid injection tube for cooling a low-pressure chamber communicating with the low-pressure port.

5. The multi-stage capacity-controlled scroll compressor according to claim 1, wherein the first opening/closing means and the second opening/closing means operate on a pilot pressure, and a pilot port of the first opening/closing means and a pilot port of the second opening/closing means are connected to their corresponding pilot lines, respectively, via one joint fitting provided at an upper center of the compressor body.

6. A multi-stage capacity-controlled scroll compressor comprising:

the multi-stage capacity-controlled scroll compressor as defined in claim 1, and a standard scroll compressor of a specified discharge capacity, wherein the multi-stage capacity-controlled scroll compressor and the standard scroll compressor are connected to each other in parallel.

7. The multi-stage capacity-controlled scroll compressor according to claim 1, wherein the first opening/closing means operates on a pilot pressure, and a pilot port of the first opening/closing means and joint fittings for connecting a pilot port are connected to each other by screws.

8. A multi-stage capacity-controlled scroll compressor comprising:

a casing;

a compression portion having a first scroll and a second scroll and arranged in the casing such that a fluid working chamber is defined between the first and second scrolls;

a discharge chamber formed between the compression portion and an inner surface of the casing;

a first bypass passage communicating a port that is formed in the fluid working chamber between a low-pressure port at one end of the fluid working chamber and a high-pressure port at the other end of the fluid working chamber with the low-pressure port;

a first opening/closing means for opening and closing the first bypass passage; including a bypass valve in said first bypass passage and a valve controller providing operating pressure to said bypass valve;

a second bypass passage provided outside of the casing and separate from said valve controller for communicating the discharge chamber with a suction-side chamber communicating with the low-pressure port;

a second opening/closing means for opening and closing the second bypass passage.

9. The multi-stage capacity-controlled scroll compressor according to claim 8, wherein the second bypass passage and the second opening/closing means are provided each in a plural number.

10. The multi-stage capacity-controlled scroll compressor according to claim 8, wherein the second opening/closing means for opening and closing the second bypass passage is a motor-operated valve which is controllable to any arbitrary degree of openness.

11. The multi-stage capacity-controlled scroll compressor according to claim 8, wherein said valve controller and said second bypass passage are connected in parallel between a suction-side line and a high-pressure line.

* * * * *